US005462579A

United States Patent [19]

Narahara et al.

[11] Patent Number: 5,462,579

[45] Date of Patent: Oct. 31, 1995

[54] METHOD AND APPARATUS FOR MANUFACTURING MEDIUM OR LOW CARBON FERROMANGANESE

[75] Inventors: Hiroshi Narahara; Kouji Suzuki, both of Kurashiki, Japan

[73] Assignee: Mizushima Ferroalloy Co., Ltd., Japan

[21] Appl. No.: 302,820

[22] PCT Filed: Oct. 14, 1993

[86] PCT No.: PCT/JP93/01476

§ 371 Date: Sep. 14, 1994

§ 102(e) Date: Sep. 14, 1994

[87] PCT Pub. No.: WO94/26946

PCT Pub. Date: Nov. 24, 1994

[30] Foreign Application Priority Data

May 18, 1993 [JP] Japan ..... 5-116059

[51] Int. Cl.[6] ..... C22B 47/00

[52] U.S. Cl. ..... 75/624; 75/625; 266/156

[58] Field of Search ..... 75/625, 624; 266/156

[56] References Cited

U.S. PATENT DOCUMENTS 4,576,638 3/1986 Doerr ..... 75/625

4,662,937 5/1987 Katayama ..... 75/625

FOREIGN PATENT DOCUMENTS 59-215458 12/1984 Japan .

61-272345 12/1986 Japan .

63-195244 8/1988 Japan .

2-4938 1/1990 Japan .

*Primary Examiner*—Peter D. Rosenberg

*Attorney, Agent, or Firm*—Austin R. Miller

[57] ABSTRACT

An object of the present invention is to provide method and apparatus for manufacturing medium or low carbon ferromanganese at reduced running costs.

In order to achieve the above object, the present invention resides in charging molten high carbon ferromanganese into a refining vessel of a top blowing type, and blowing oxygen gas on the surface of the molten high carbon ferromanganese from above and injecting a mixed gas having the following composition into the molten high carbon ferromanganese from bottom. The mixed gas composition comprises 65–100% of CO, 0– 25% of $CO_2$ and 0–10% of $N_2$. In a case, argon gas is used as the bottom-blown gas.

8 Claims, 4 Drawing Sheets

METHOD AND APPARATUS FOR MANUFACTURING MEDIUM OR LOW CARBON FERROMANGANESE

TECHNICAL FIELD

This invention relates to method and apparatus for manufacturing medium or low carbon ferromanganese.

BACKGROUND ART

It is usual practice to produce medium or low carbon ferromanganese by decarburizing molten high carbon ferromanganese in converters. It is known that the decarburization reaction rate of the molten high carbon ferromanganese is determined according to the following major factors.

1. Temperature of molten ferromanganese
2. Agitation of molten ferromanganese
3. Gas composition blown from bottom tuyeres.

Among these factors, the temperature of the molten ferromanganese is set out in detail in U.S. Pat. No. 3,305,353. According to this patent, the conditions of causing the decarburization to proceed quickly in a pure oxygen top-blown converter where the oxygen gas is blown on the surface of the molten-high carbon manganese, include a molten metal temperature not lower than 1550° C. It is set out that in order to cause decarburization to proceed while suppressing oxidation of Mn in a medium or low carbon concentration region, the molten metal temperature should be not lower than 1700° C. before the carbon concentration of the molten metal reaches 1.5 wt. % or below.

Among the above factors, the agitation of the molten ferromanganese is set forth in Japanese Patent Publication No. 57-27166. According to this publication, the decarburization proceeds very efficiently when using a converter which has double-pipe bottom tuyeres. More particularly, the yield of Mn amount in a pure oxygen top-blown converter (i.e. a converter which has no bottom tuyeres at the bottom thereof) is 79%. With a pure oxygen top blown converter having double-pipe bottom tuyeres, the yield of Mn amount is very high at 92%. The molten metal is more strongly stirred by the bottom-blown gas, thereby obtaining a high decarburization reaction efficiency.

The gas composition blown through the bottom tuyeres which is one of the factors is set out in Japanese Patent Publication No. 3-55538 in which reference is made to the above-indicated U.S. Pat. No. 3,305,352 and Japanese Patent Publication No. 57-27166 as prior art. According to this publication, when a bottom-blown gas is charged through the bottom tuyeres of a pure oxygen top blown converter, the composition of the bottom-blown gas is important. In the publication, argon gas, nitrogen gas, carbon dioxide gas or mixtures are used as the bottom-blown gas.

However, if argon gas, nitrogen gas, carbon dioxide gas or mixtures thereof are used on an industrial scale in decarburization of molten high carbon ferromanganese in a pure oxygen top-blown converter having bottom tuyeres, there arise the following problems.

(1) The use of nitrogen gas has the problem that the nitrogen concentration in ferromanganese increases. Usually, nitrogen is saturated at a concentration of 300–400 ppm in high carbon ferromanganese. As the decarburization proceeds, the nitrogen concentration increases. Especially, in medium or low carbon ferromanganese whose carbon concentration is 2.5% or below, the nitrogen concentration increases in proportion to the total of the bottom-blown nitrogen gas. Finally, the concentration increases up to a maximum value of approximately 10,000 ppm.

(2) The use of carbon dioxide gas has the problem that it considerably damages the bottom tuyeres and refractories therearound. The reason for this is that when carbon dioxide gas contacts with the high temperature molten metal just on the bottom tuyeres, the following dissociation reaction proceeds $$CO_2\ (g) \rightarrow CO\ (g) + \tfrac{1}{2}O_2\ (g).$$

The released $O_2$ (g) serves to damage refractories. As a result, the life of the converter refractories lowers, with a considerable increase in running costs.

As stated above, when medium or low ferromanganese is manufactured on an industrial scale using argon gas, nitrogen gas or carbon dioxide gas as the bottom-blown gas, the resultant medium or low carbon ferromanganese has a high nitrogen concentration thereby producing the problem that the bottom tuyeres and nearby refractories are damaged.

Under these circumstances in the art, the present invention has for its first object the provision of a method for manufacturing medium or low carbon ferromanganese whereby bottom tuyeres and nearby refractories are prevented from being damaged, with low running costs.

In order to employ argon gas, nitrogen gas or carbon dioxide gas on an industrial scale, a large-scale gas generator is necessary. In case where a commercially sold gas is used, large-scale storage and evaporation facilities are required. This will prevent the problem that production cost of the medium or low carbon ferromanganese becomes high.

Accordingly, the present invention has its second object the provision of method and apparatus for manufacturing meduium or carbon ferromanganese at low costs.

DISCLOSURE OF THE INVENTION

In order to attain the above first object, there is provided a method for manufacturing medium or low carbon ferromanganese wherein medium or low carbon ferromanganese is manufactured by refining molten high carbon ferromanganese in a converter which provides a top lance and bottom tuyeres, characterized by blowing oxygen gas through the top lance on the surface of the molten high carbon ferromanganese, and, at the same time, injecting through the bottom tuyeres a mixed gas whose composition comprises 65–100% of CO gas, 0–25% of $CO_2$ gas and 0–10% of $N_2$ gas, into the molten high carbon ferromanganese at a ratio of 12–30 parts by volume per 100 parts by volume of the oxygen gas calculated as the standard state of a flow rate of the blown oxygen gas.

The flow rate of the mixed gas may be increased depending on the lowering in decarburization efficiency during the course of refining, under which the mixed gas is injected into the molten high carbon ferromanganese.

Moreover, the flow rate of the bottom-blown gas may be increased depending on the lowering in carbon concentration of the molten ferromanganese, under which the mixed gas is injected into the molten ferromanganese. When the carbon concentration exceeds 2%, the flow rate of the bottom-blown gas should preferably be not larger than 3 parts by volume per 100 parts by volume of the oxygen gas on calculation as the standard state of a flow rate of the blown oxygen gas. On the contrary, when the carbon concentration is not higher than 2%, the flow rate of the bottom-blown gas is preferably in the range of 12–30 parts by volume per 100 parts by volume of the oxygen gas, calculated as the standard state of the flow rate of the blown oxygen gas. More preferably, when the carbon concentration is in the range of from 1% to 2%, the flow rate is in the range of 15–20 parts by volume per 100 parts by volume of the oxygen gas calculated as the standard state. Likewise, when the carbon concentration is less than 1%, the flow rate is in the range of 20–30 parts by volume per 100 parts by volume of the oxygen gas calculated as the standard state. In the case, mixed gases, or argon or the like may be used as the bottom-blown gas.

The apparatus for manufacturing medium or low carbon ferromanganese by which the second object of the invention can be achieved should include a top lance and bottom tuyeres, characterized by comprising:

(1) a combustion gas collector located in the converter to collect a combustion gas in the converter;

(2) a storage tank connected to the combustion gas collector to store the combustion gas fed from the collector; and (3) a feeder connected to the storage tank to feed the combustion gas from the storage tank toward the bottom tuyeres.

It is preferred that a dust removing device for removing dust from the combustion gas is provided between the combustion gas collector and the storage tank.

The method for manufacturing medium or low carbon ferromanganese by which the second object of the invention can be achieved is characterized by collecting a combustion gas generated during refining by use of the apparatus for manufacturing medium or low carbon ferromanganese and by providing the thus collected combustion gas as a whole or part of a gas blown through the bottom tuyeres into molten high carbon ferromanganese.

In the method for manufacturing medium or low carbon ferromanganese according to the invention, the mixed gas blown through the bottom tuyeres comprises 65– 100% of CO gas, 0–25% of $CO_2$ gas and 0–10% of $N_2$ gas. The mixed gas is fed at a ratio of 12–30 parts by volume per 100 parts by volume of the oxygen gas calculated as the standard state of a flow rate of the oxygen gas through the top lance. Since the concentration of carbon dioxide gas is suppressed to a low level, the bottom tuyeres and nearby refractories are prevented from damage, thus leading to low running costs.

Where the flow rate of the mixed gas injected into the molten high carbon ferromanganese is increased in response to a lowering in decarburization efficiency during the refining or to a lowering in carbon concentration of the molten ferromanganese, the decarburization proceeds in high efficiency at a reduced flow rate of the gas.

Better decarburization efficiencies are obtained when the flow rate of the mixed gas is not higher than 3 parts by volume per 100 parts by volume of the oxygen gas, calculated as the standard state of a flow rate of the blown gas, at a carbon concentration exceeding 2% or when the flow rate is in the range of 12–30 parts by volume per 100 parts by volume of the oxygen gas, calculated as the standard state, at a carbon concentration not higher than 2%.

Likewise, better decarburization efficiencies are attained when at a carbon concentration of from 1% to 2%, the flow rate of the mixed gas is in the range of 15–20 parts by volume per 100 parts by volume of the oxygen gas calculated as the standard state and when at a carbon concentration of less than 1%, the mixed gas is injected at a ratio of 20–30 parts by volume per 100 parts by volume of the oxygen gas calculated as the standard state.

With the medium or low carbon ferromanganese manufacturing apparatus of the invention, the combustion gas is collected by means of the combustion gas collector located in the converter and is stored in the storage tank. The combustion gas stored in the tank is again blown into the converter through the feeder. Since the combustion gas can be re-utilized, the manufacturing costs for medium or low carbon ferromanganese can be reduced.

EMBODIMENTS

Embodiments of the invention are described with reference to the accompanying drawings.

Figure 1:
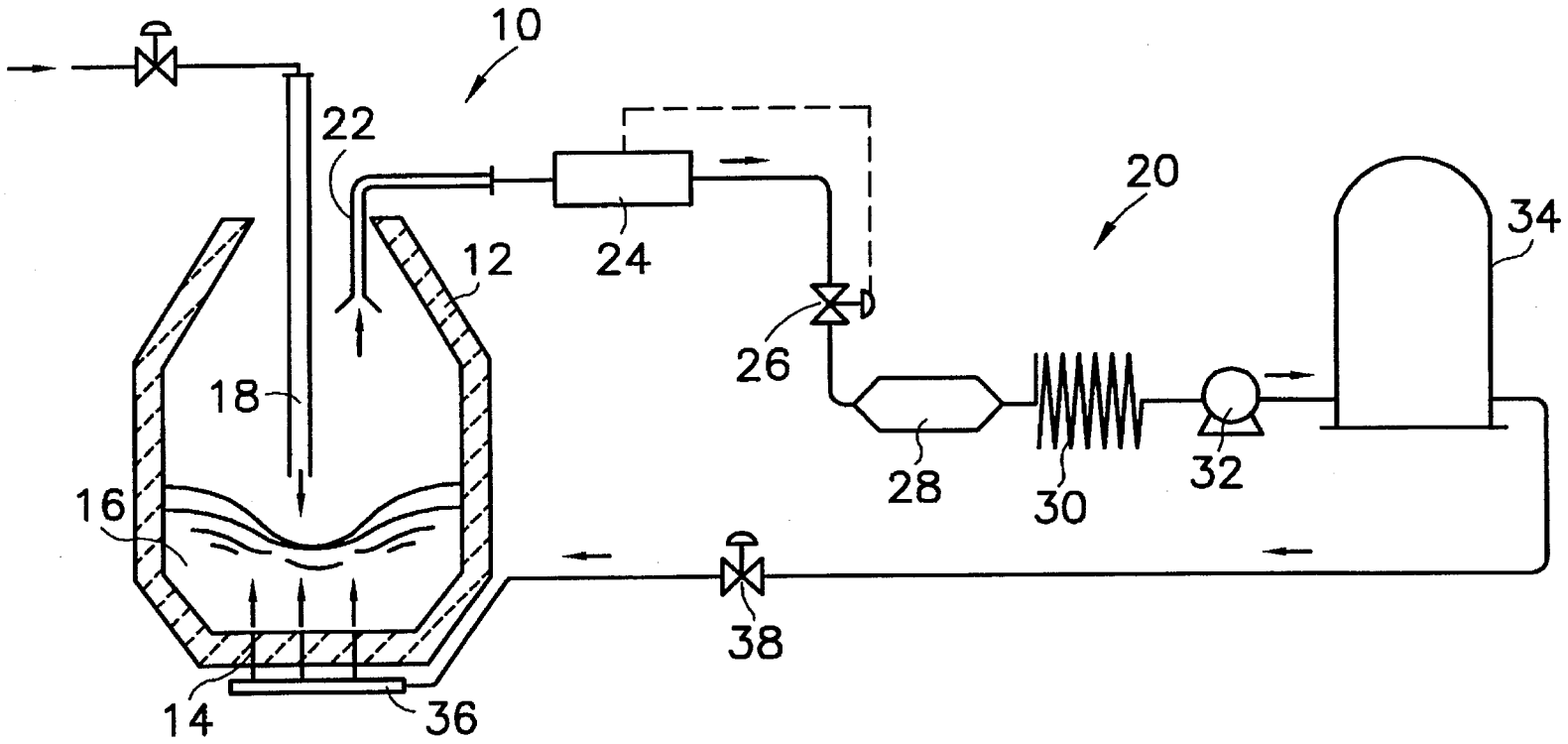
FIG. 1 is a schematic view showing an apparatus for manufacturing medium or low carbon ferromanganese according to an embodiment of the invention.

Reference is now made to FIG. 1 to illustrate an apparatus for manufacturing medium or low carbon ferromanganese according to one embodiment of the invention.

FIG. 1 is a schematic view of an apparatus for manufacturing medium or low carbon ferromanganese according to one embodiment of the invention.

A medium or low carbon ferromanganese manufacturing apparatus 10 includes a converter 12. The converter 12 has tuyeres 14, serving as bottom tuyeres and each made of a stainless steel pipe with an inner diameter of 4 mm, which are provided at three portions of the converter bottom as kept away from one another. The converter also has a top lance 18 through which oxygen gas is blown on the surface of molten high carbon ferromanganese 16 in the converter 12. The arrangement as stated above is similar to that of hitherto known converters.

The manufacturing apparatus 10 is further provided with a combustion gas re-utilization unit 20 wherein the combustion gas generated in the converter 12 is collected and once stored, and is again blown into the converter 12 through the tuyeres 14. By the provision, manufacturing costs of the medium or low carbon ferromanganese can be reduced.

In the unit 20, the combustion gas generated in the converter 12 is collected in a combustion gas collector 22 and subjected to a gas concentration analyzer 24 to analyze concentrations of the respective gases including CO gas, $CO_2$ gas, $O_2$ gas and the like. A gas suction automatic make and break valve 26 is opened or closed in response to the gas concentrations analyzed in the analyzer 22. When intended gas concentrations are not obtained, the valve 26 is closed. The combustion gas passing through the valve 26 is subjected to dust removal in a dust removing device 28, followed by cooling in a gas cooler 30 and storage in a small-size storage tank 34 at high pressure by use of a suction and booster pump 32. The combustion gas stored in the small-size storage tank 34 is fed to the bottom tuyeres 14 through a feeder 36. By closing the valve 38, the feed of the combustion gas to the tuyeres 14 can be stopped. A plurality of spare reserve tanks (not shown in FIG. 1) in which a gas having an intended composition has been stored may be connected to the tank 34. In the case, if the gas concentrations of the respective gas components in the combustion gas collected in the collector 22 are, respectively, outside intended ranges, such a combustion gas is not stored in the storage tank 34. Instead, a gas with a required composition is fed from the spare reserve tank to attain intended concentrations of the respective gases in the combustion gas.

Figure 2:
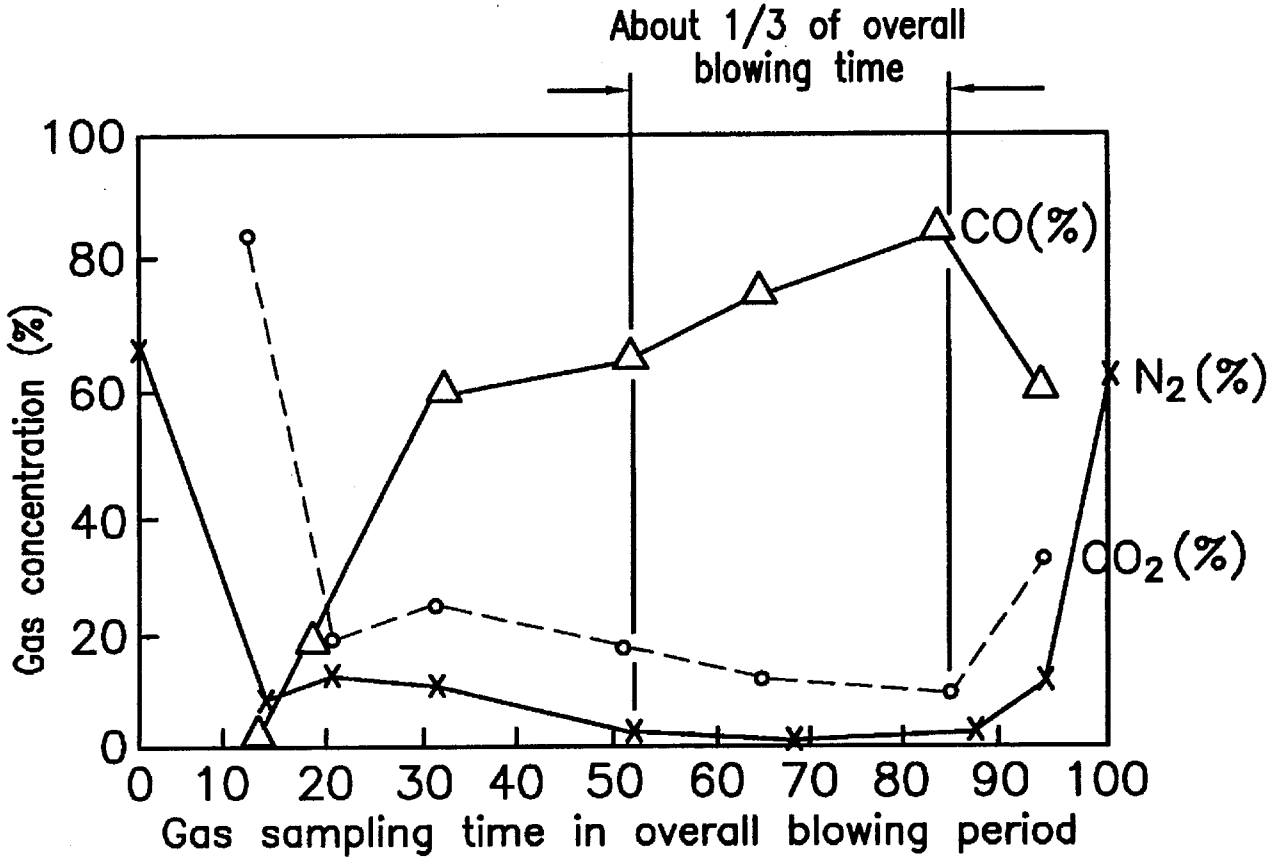
FIG. 2 is a graph showing the variation in compositional ratio of a combustion gas produced during blowing in a 5 tons converter.

Reference is now made to FIG. 2 to illustrate a combustion gas collected in the re-utilization unit 20.

The combustion gas generated on decarburization and refining of the molten high carbon ferromanganese by blowing oxygen gas on the surface of the molten high carbon ferromanganese in the converter consists of a mixed gas comprised of a major proportion of CO gas along with $N_2$ gas and $CO_2$ gas. Usually, the decarburization reaction proceeds as follows: $C+1/2O_2$ (g)→CO (g). The produced CO (g) undergoes secondary combustion with either oxygen gas which is in excess of the oxygen gas blown in the converter or oxygen included in air incorporated at a throat of the converter, thereby causing the reaction of CO (g)+ $1/2O_2$ (g)→$CO_2$ (g). The combustion gas contains nitrogen in the incorporated air.

FIG. 2 is a graph showing the change in compositional ratio of the combustion gas produced during the course of the decarburization and refining in a five tons converter. The decarburization and refining is carried out by uniformly blowing an oxygen gas at a flow rate of 2.5 $Nm_3$/t·min through the top lance and a bottom-blown Ar gas at a flow rate of 3.4 $Nm_3$/t over an overall blowing period. The combustion gas which has been sucked through a 20A castable processed pipe at a position of 400 mm from the upper end of the throat of the converter is collected at intervals of 10 minutes and analyzed. As will be apparent from FIG. 2, a combustion gas which satisfies the requirement for a mixed gas composition with ranges of CO≧65%, $CO_2$≦25 and $N_2$≦10% is produced at the middle to end stages of the blowing during a time of about ⅓ of the total blowing time period. The concentrations of nitrogen and carbon dioxide gasses in the composition can be further reduced by interrupting the air to be incorporated at the throat of the converter. Accordingly, while interrupting the incorporation of air at the throat of the converter, the combustion gas having the above-indicated composition ranges can be further increased in amount.

Where the combustion gas is employed as the bottom-blown gas, it is used, in a maximum, up to 30 parts by volume per 100 parts by volume of oxygen gas, calculated as the standard state of the flow rate of top blown pure oxygen. Accordingly, the amount of the sucked and collected combustion gas can be adequately dealt with a gas collection, storage and feed system shown in FIG. 1.

Next, there is described a method for manufacturing medium or low carbon ferromanganese from molten high carbon ferromanganese by use of the medium or low ferromanganese manufacturing apparatus 10.

In order to attain a decarburization reaction higher than in prior art by decarburizing and refining molten high carbon ferromanganese according to the method of the invention, a mixed gas having a composition which comprises 65–100% of CO gas, 0–25% of $CO_2$ gas and 0–10% of $N_2$ gas is used as a gas blown through the bottom tuyeres. In addition, the mixed gas is blown at a constant flow rate of 3.4 $Nm^3$/t over the whole period of oxygen top blowing. The mixed gas used satisfies the above-indicated compositional ratios and is obtained in the combustion gas re-utilization unit 20 at the middle stage of blowing. The converter used is on the scale of five tons.

Examples wherein bottom blowing is carried out using a gas composition as set forth above are shown along with comparative examples in Table 1. In Table 1, there are shown the types and flow rates of bottom blown gases, the tuyere loss rate (mm/charge), molten metal components (C, Mn) prior to decarburization and refining treatments, molten metal components after decarburization and refining treatments (C, Mn, [N]) and indicies of running costs for bottom blowing.

TABLE 1

| | Prior to Treatments | | After Treatments | | | Flow Rate of Bottom | Bottom Blown Gas Composition | | | | Tuyere Loss | Bottom Blowing | Gas Flow Rate Bottom Blown |
|---|---|---|---|---|---|---|---|---|---|---|---|---|---|
| | % C | % Mn | % C | % Mn | % [N] | Blown Gas ($Nm^3$/t) | % CO | % $CO_2$ | % $N_2$ | % Ar | Rate (mm/Charge) | Cost Index | Gas/Top Blown Gas* |
| Comparative Example 1 | 6.96 | 73.3 | 1.62 | 73.6 | 0.04 | 3.4 | — | — | — | 100 | 0.31 | 100 | 17/100 |
| Comparative Example 2 | 7.07 | 73.1 | 1.52 | 71.9 | 0.81 | 3.4 | — | — | 100 | — | 0.38 | 42 | 18/100 |
| Comparative Example 3 | 7.02 | 73.3 | 1.62 | 72.8 | 0.03 | 3.4 | — | 100 | — | — | 2.18 | 343 | 25/100 |
| Comparative Example 4 | 7.01 | 73.2 | 1.59 | 72.4 | 0.06 | 3.4 | 60 | 35 | 5 | — | 1.01 | 181 | 20/100 |
| Comparative Example 5 | 7.02 | 72.8 | 1.62 | 71.7 | 0.06 | 3.4 | 65 | 30 | 5 | — | 0.93 | 127 | 15/100 |
| Comparative Example 6 | 7.00 | 73.1 | 1.54 | 72.1 | 0.14 | 3.4 | 70 | 15 | 15 | — | 0.54 | 59 | 23/100 |
| Example 1 | 6.91 | 72.0 | 1.54 | 73.0 | 0.05 | 3.4 | 83 | 15 | 2 | — | 0.51 | 57 | 16/100 |
| Example 2 | 6.96 | 73.3 | 1.53 | 72.9 | 0.09 | 3.4 | 65 | 25 | 10 | — | 0.78 | 98 | 25/100 |
| Example 3 | 6.93 | 73.4 | 1.64 | 73.0 | 0.08 | 3.4 | 70 | 20 | 10 | — | 0.69 | 69 | 13/100 |
| Example 4 | 6.99 | 73.2 | 1.52 | 73.6 | 0.04 | 3.4 | 100 | — | — | — | 0.35 | 35 | 20/100 |

As will be apparent from Table 1, for all the gases, the yield of Mn amount became 93–96% by the bottom blowing effect. In Comparative Example 3 wherein 100% of $CO_2$ gas is used, it has been found that the bottom tuyeres and nearby refractories are considerably damaged, so that the tuyere loss rate is 3– 7 times greater than those of other examples and comparative examples. With Comparative Example 2 using 100% of nitrogen gas, the nitrogen concentration after the decarburization and refining treatments is about 8,100 ppm, which is 16–27 times higher than in other examples and comparative examples. With Comparative Example 1 using 100% argon gas, argon gas is so expensive that the running cost becomes higher than in Comparative Example 2. In Examples 1–4, the tuyere loss rate and the nitrogen concentration after the decarburization and refining treatments are both low. Thus, it has been found that the gases used in Examples 1–4 are useful as a bottom-blown gas. However, when the rate of nitrogen gas in the bottom-blown gas is not less than 15%, the nitrogen concentration after the decarburization and refining exceeds 1000 ppm (Comparative Example 6). For the manufacture of medium or low carbon ferromanganese, it has been found necessary to make the ratio of nitrogen gas at 10% or below in order to assure the nitrogen concentration not larger than 1000 ppm after the decarburization and refining. When the carbon monoxide gas concentration is 100%, the tuyere loss rate becomes very low (Example 4). Thus, it has been found that in order to produce medium or low carbon ferromanganese on an industrial scale, it is necessary to use a bottom-blown gas whose carbon dioxide gas concentration is not higher than 25% in order to ensure a tuyere loss rate which is not larger than double that of Example 4.

Gathering the above, in the top-and bottom-blown converter, the bottom-blown gas composition used to produce industrially medium or low high carbon ferromanganese should comprise 65–100% of CO gas, 0–25% $CO_2$ gas and 0–10% of $N_2$ gas.

Next, another procedure for manufacturing medium or low carbon ferromanganese from molten high carbon ferromanganese by use of the above-described medium or low carbon ferromanganese manufacturing apparatus 10 is described.

Figure 3:
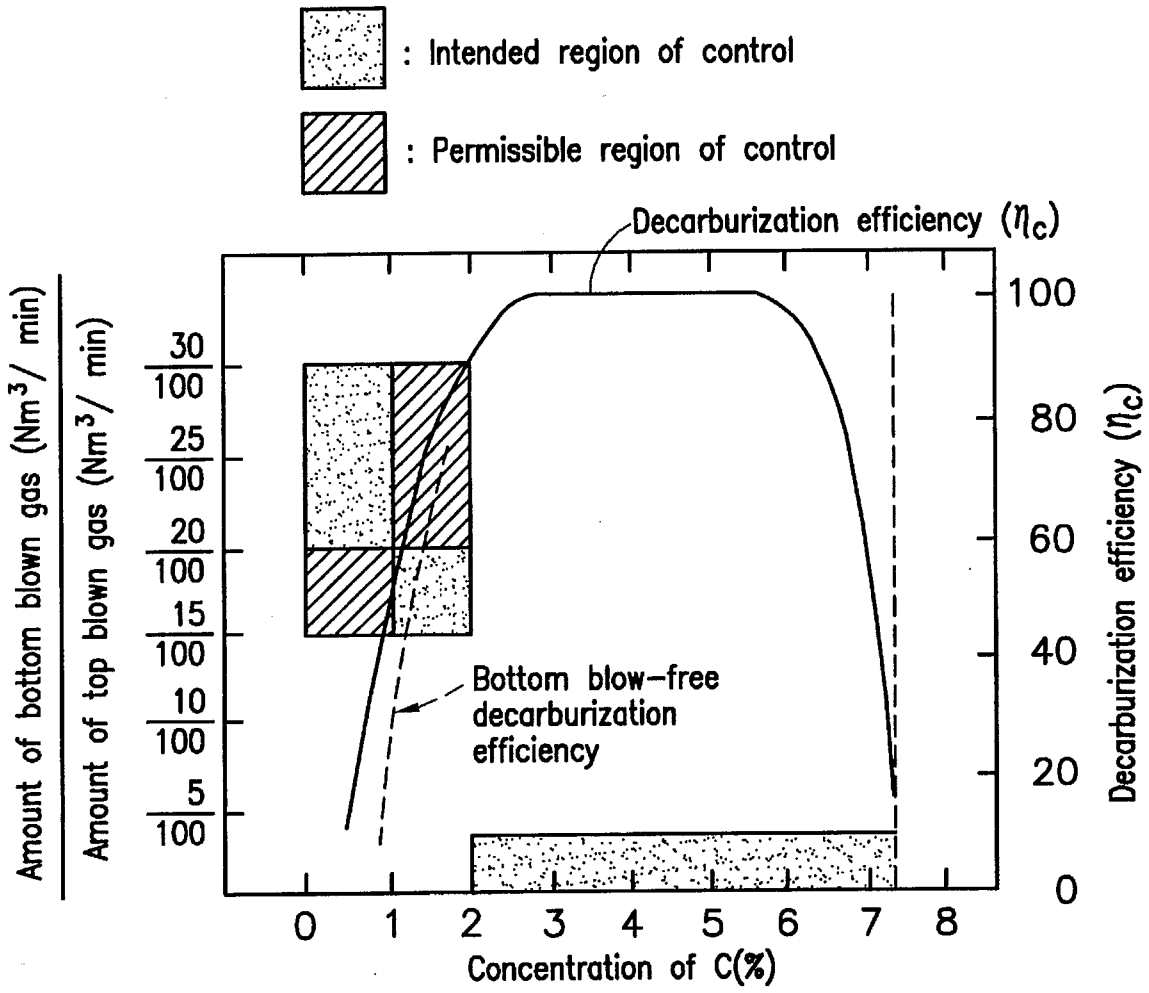
FIG. 3 is a graph showing the relation between the amount of a bottom-blown gas and the carbon concentration in molten high carbon ferromanganese during blowing.

FIG. 3 is a graph showing the relationship between the bottom blown gas flow rate, the carbon concentration of molten high carbon ferromanganese and the decarburization efficiency in the manufacture of medium or low carbon ferromanganese.

In this manufacturing method wherein molten high carbon ferromanganese is decarburized and refined, the final carbon concentration is presumed in terms of the blown oxygen amount (cumulative amount) and the decarburization efficiency, and the flow rate of the bottom-blown gas is changed. The decarburization efficiency is obtained from (effective amount of oxygen in decarburization reaction ($Nm^3$)/amount of blown oxygen ($Nm^3$)). The bottom-blown gas used is the mixed gas obtained from combustion gas re-utilization unit 20 at the middle stage of refining. The converter is on the scale of five tons. In these cases, similar results are obtained when using argon instead of the mixed gas.

The bottom blown gas flow rate is important for causing the molten metal in the converter to reliably stir during the course of blowing and also for expediting the reaction between the top-blown gas and carbon on the surfaces of the molten metal. However, in the decarburization and refining of the molten ferromanganese, as shown in FIG. 3, since the decarburization efficiency based on the top-blown oxygen is about 100% until the carbon concentration in the molten metal becomes 2%, little stirring effect of the bottom-blown gas is recognized. Accordingly, the flow rate of the bottom-blown gas should be in such an extent as not clog the bottom tuyeres up to a carbon concentration of 2% in the molten metal. More particularly, the flow rate is kept at a ratio of not larger than 3 parts by volume per 100 parts by volume of the top-blown gas calculated as a standard state (hereinafter referred to as 3/100). However, if the carbon concentration in the molten metal is lower than 2%, the frequency of contact between the top-blown oxygen gas and the carbon in the molten metal is decreased. Thus, it has been recognized that the stirring force is increased with an increase in the bottom-blown gas flow rate (12/100–30/100, preferably 12/100–20/100) and the decarburization efficiency is improved by the action of the bottom-blown mixed gas. Moreover, as shown in FIG. 3, when the carbon concentration is lower than 1%, an increasing degree of stirring is more advantageous for the decarburization efficiency. The bottom-blown gas flow rate of 15/100–30/100, preferably 20/100–30/100 contributes to improving the decarburization efficiency of the top blown oxygen gas. It has been confirmed that the increase in the bottom-blown gas flow rate at a low carbon concentration (not higher than 2%) lowers the partial pressure of carbon monoxide gas on the surfaces of the molten metal, thereby promoting the decarburization reaction.

Figure 4:
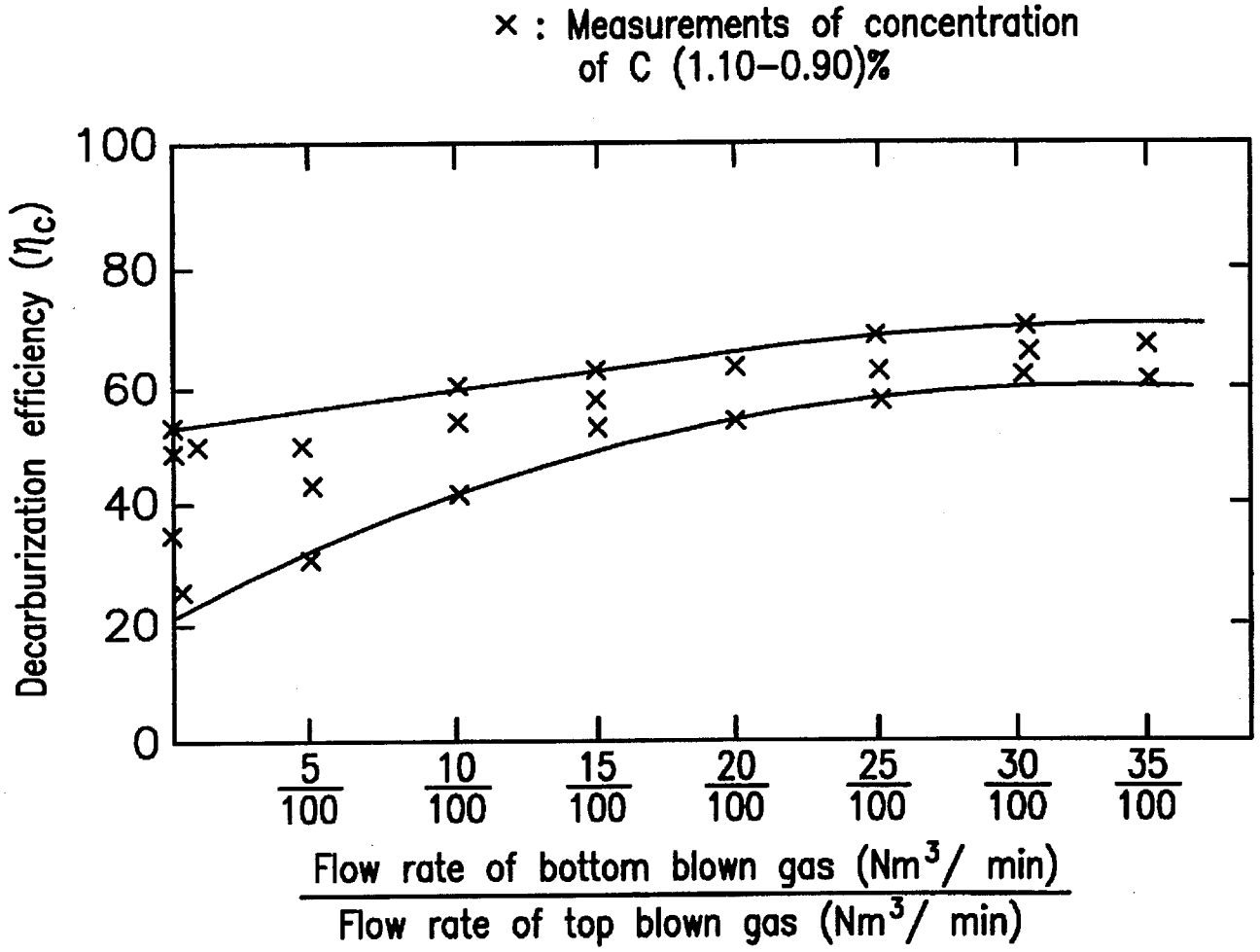
FIG. 4 is a graph showing the relation between the scattering of a decarburization efficiency in a range of low carbon concentration (0.90%–1.10%) and the bottom-blown gas flow rate.

Reference is now made to FIG. 4 in which there is shown the scattering of the decarburization efficiency in a low carbon concentration(0.90%–1.10

).

As shown in FIG. 2, the decarburization efficiency of the top-blown oxygen gas in the low carbon concentration (0.90%–1.10%) is lower at a lower bottom-blown gas flow rate, with a greater scattering of the decarburization efficiency. If the bottom-blown gas flow rate is increased nearly to 30/100, the decarburization efficiency becomes maximum, with a reduced scattering of the decarburization efficiency.

INDUSTRIAL APPLICABILITY

Using the method for manufacturing medium or low carbon ferromanganese, the concentration of carbon dioxide gas in a bottom-blown gas is suppressed to a low level, so that the bottom tuyeres and nearby refractories are prevented from being damaged, resulting in low running costs. Moreover, the flow rate of the bottom-blown gas is increased in response to the lowering in decarburization efficiency during blowing or in carbon concentration of molten high carbon ferromanganese. Accordingly, the decarburization can be performed efficiently at a small gas flow rate.

If there is used an apparatus for manufacturing medium or low carbon ferromanganese according to the present invention, the combustion gas stored in a storage tank is again blown through a feeder to a converter. Thus, the combustion gas in the converter can be re-utilized. In view of this, it will be expected to reduce the manufacturing costs of medium or low carbon ferromanganese.

We claim:

1. A method for manufacturing medium or low carbon ferromanganese wherein medium or low carbon ferromanganese is manufactured by decarburizing molten high carbon ferromanganese in a converter which provides a top lance and bottom tuyeres, comprising blowing oxygen gas through said top lance on the surface of said molten high carbon ferromanganese, and, at the same time, injecting through said bottom tuyeres a mixed gas whose composition comprises 65– 100% of CO gas, 0–25% of $CO_2$ gas and 0–10% of $N_2$ gas, into said molten high carbon ferromanganese at a ratio of 12–30 parts by volume per 100 parts by volume of the oxygen gas calculated as the standard state of the blown oxygen gas.

2. A method for manufacturing medium or low carbon ferromanganese wherein medium or low carbon ferromanganese is manufactured by decarburizing molten high carbon ferromanganese in a converter which provides a top lance and bottom tuyeres, comprising blowing oxygen gas through said top lance on the surface of said molten high carbon ferromanganese, and, at the same time, injecting through said bottom tuyeres a mixed gas whose composition comprises 65– 100% of CO gas, 0–25% of $CO_2$ gas and 0–10% of $N_2$ gas, into said molten high carbon ferromanganese while increasing a flow rate of said mixed gas corresponding to a lowering in decarburization efficiency which occurs during the blowing.

3. A method for manufacturing medium or low carbon ferromanganese wherein medium or low carbon ferromanganese is manufactured by decarburizing molten high carbon ferromanganese in a converter which provides a top lance and bottom tuyeres, comprising blowing oxygen gas through said top lance on the surface of said molten high carbon ferromanganese, and, at the same time, injecting through said bottom tuyeres a mixed gas whose composition comprises 65–100% of CO gas, 0–25% of $CO_2$ gas and 0–10% of $N_2$ gas, into said molten high carbon ferromanganese while increasing a flow rate of said mixed gas corresponding to a lowering in carbon concentration in said molten high carbon ferromanganese.

4. A method for manufacturing medium or low carbon ferromanganese according to claim 3, wherein the flow rate of said mixed gas is not higher than 3 parts by volume per 100 parts by volume of said oxygen gas calculated as a standard state thereof when the carbon concentration exceeds 2%, and is in the range of 12–30 parts by volume per 100 parts by volume of said oxygen gas calculated as the standard state when the carbon concentration is lower than 2%.

5. A method for manufacturing medium or low carbon ferromanganese according to claim 1, 2, 3 or 4, characterized in that said mixed gas comprises a combustion gas generated and collected during the blowing.

6. A method for manufacturing medium or low carbon ferromanganese wherein medium or low carbon ferromanganese is manufactured by decarburizing molten high carbon ferromanganese in a converter which provides a top lance and bottom tuyeres, comprising blowing oxygen gas through said top lance on the surface of said molten high carbon ferromanganese, and, at the same time, injecting through said bottom tuyeres argon gas at a ratio of not higher than 3 parts by volume per 100 parts by volume of said oxygen gas calculated as a standard state thereof when the carbon concentration exceeds 2%, and at a ratio of 12–30 parts by volume per 100 parts by volume of said oxygen gas calculated as the standard state when the carbon concentration is lower than 2%.

7. An apparatus for manufacturing medium or low carbon ferromanganese which has a top lance and bottom tuyeres, comprising:

a combustion gas collector located in the converter for recycling to collect a combustion gas in the converter;

a storage tank connected to the combustion gas collector to store the combustion gas fed from the collector; and a feeder connected to the storage tank to feed the combustion gas from the storage tank toward the bottom tuyeres.

8. In a method of manufacturing medium or low carbon ferromanganese of the type where gas is introduced into molten ferromanganese by bottom blowing during decarburization, the improvement comprising:

collecting combustion gas during decarburization when the composition of the combustion gas is about 65–100% CO gas, about 0–25% $CO_2$ gas and about 0–10% $N_2$ gas, and wherein said collected gas is recycled and introduced into molten ferromanganese by bottom blowing during decarburization.

* * * * *